US010435046B2

(12) United States Patent
Liu et al.

(10) Patent No.: US 10,435,046 B2
(45) Date of Patent: Oct. 8, 2019

(54) COUPLER UNCOUPLING CONTROL MECHANISM

(71) Applicant: QINGDAO SRI TECHNOLOGY CO., LTD., Qingdao (CN)

(72) Inventors: Quan Liu, Qingdao (CN); Hui Liu, Qingdao (CN); Kai Chen, Qingdao (CN)

(73) Assignee: QINGDAO SRI TECHNOLOGY CO., LTD., Shandong (CN)

( * ) Notice: Subject to any disclaimer, the term of this patent is extended or adjusted under 35 U.S.C. 154(b) by 0 days.

(21) Appl. No.: 16/392,523

(22) Filed: Apr. 23, 2019

(65) Prior Publication Data

US 2019/0248388 A1 Aug. 15, 2019

Related U.S. Application Data

(63) Continuation of application No. PCT/CN2018/073167, filed on Jan. 18, 2018.

(30) Foreign Application Priority Data

Apr. 18, 2017 (CN) ..... 2017 1 0253112

(51) Int. Cl.
*B61G 3/20* (2006.01)
*B61G 3/08* (2006.01)
(Continued)

(52) U.S. Cl.
CPC ..... *B61G 3/20* (2013.01); *B61G 1/32* (2013.01); *B61G 1/42* (2013.01); *B61G 3/08* (2013.01);
(Continued)

(58) Field of Classification Search
CPC ... B61G 1/32; B61G 1/40; B61G 1/42; B61G 3/16; B61G 3/20; B61G 5/06; B61G 5/08; B61G 5/10; B61G 7/10
(Continued)

(56) References Cited

U.S. PATENT DOCUMENTS 1,726,508 A * 8/1929 Van Dorn ..... B60L 15/32 213/1.6
1,924,821 A * 8/1933 Van Dorn ..... B61G 5/10 213/1.6
(Continued)

FOREIGN PATENT DOCUMENTS

CN 101348122 A 1/2009
CN 201276122 Y 7/2009
(Continued)

OTHER PUBLICATIONS

The Chinese First Examination Report, including the Search Report, of corresponding Chinese application No. 201710253112.1, dated May 22, 2018.
(Continued)

*Primary Examiner* — Zachary L Kuhfuss
(74) *Attorney, Agent, or Firm* — J.C. Patents

(57) ABSTRACT

A coupler uncoupling control mechanism is provided in the present application, comprising an uncoupling cylinder, a propelling cylinder and a control assembly, wherein the propelling cylinder is connected to a first valve body, and the first valve body comprises a first air inlet connected to the main reservoir pipe of the train, a first air outlet communicated with the first air inlet, a second air inlet and a second air outlet communicated with the second air inlet; the first air outlet is communicated with the air inlet chamber of the propelling cylinder, and the second air inlet is communicated with the air outlet chamber of the propelling cylinder. The control assembly comprises a second valve body and
(Continued)

the second valve body is a pneumatic control valve; the second valve body comprises a third air inlet communicated with the uncoupling pipe of the train, a third air outlet communicated with the third air inlet, and a first control port capable of controlling airflow communication between the third air inlet and the third air outlet after being triggered; and, the third air inlet is communicated with the air inlet of the uncoupling cylinder, and the first control port is connected to the first air outlet of the first valve body. The present application can ensure that electrical couplers are uncoupled successfully.

15 Claims, 14 Drawing Sheets

(51) Int. Cl.

| | |
|---|---|
| ***B61G 5/08*** | (2006.01) |
| ***B61G 7/10*** | (2006.01) |
| ***B61G 1/42*** | (2006.01) |
| ***B61G 1/32*** | (2006.01) |
| ***B61G 5/10*** | (2006.01) |
| ***B61G 3/26*** | (2006.01) |

(52) U.S. Cl.
CPC ..... *B61G 3/26* (2013.01); *B61G 5/08* (2013.01); *B61G 5/10* (2013.01); *B61G 7/10* (2013.01)

(58) Field of Classification Search
USPC ..... 213/1.3, 1.6, 211, 212
See application file for complete search history.

(56) References Cited

U.S. PATENT DOCUMENTS

| | | | | | |
|---|---|---|---|---|---|
| 2,161,724 | A * | 6/1939 | Scharfenberg | B61G 3/16 | 213/77 |
| 2,358,625 | A * | 9/1944 | Cameron | B61G 5/10 | 213/212 |
| 2,677,472 | A * | 5/1954 | Larsson | B61G 5/08 | 213/76 |
| 3,263,823 | A * | 8/1966 | Gobrecht | B61G 5/06 | 213/1.6 |
| 3,280,990 | A * | 10/1966 | Jeffrey | B61G 5/06 | 213/76 |
| 3,599,803 | A * | 8/1971 | Cope | B61G 5/08 | 213/76 |
| 3,690,469 | A * | 9/1972 | Nagoya | B61G 7/00 | 213/212 |
| 3,696,941 | A * | 10/1972 | Cope | B61G 5/08 | 213/76 |
| 3,743,110 | A * | 7/1973 | Cope | B61G 5/08 | 213/76 |
| 3,743,111 | A * | 7/1973 | Shimada | B61G 3/08 | 213/212 |
| 4,049,128 | A | 9/1977 | Jeffrey | | |
| 4,703,862 | A * | 11/1987 | Werner | B61G 5/08 | 213/76 |
| 4,892,204 | A * | 1/1990 | Lumbis | B61G 5/06 | 213/1.3 |
| 5,094,354 | A * | 3/1992 | Lindner | B61G 5/06 | 213/1.3 |
| 5,139,158 | A * | 8/1992 | Lindner | B61G 5/06 | 213/1.3 |
| 5,152,410 | A * | 10/1992 | Ta | B61G 7/14 | 213/212 |
| 5,449,295 | A * | 9/1995 | Hanano | B61G 5/10 | 439/310 |
| 5,503,280 | A * | 4/1996 | Hanano | B61G 3/20 | 213/211 |
| 2018/0094473 | A1* | 4/2018 | Liu | B61D 17/06 | |
| 2019/0144013 | A1* | 5/2019 | Liu | B61G 3/08 | 213/211 |

FOREIGN PATENT DOCUMENTS

| | | | | |
|---|---|---|---|---|
| CN | 101698412 | A | 4/2010 | |
| CN | 201901162 | U | 7/2011 | |
| CN | 103863352 | A | 6/2014 | |
| CN | 203819258 | U | 9/2014 | |
| CN | 104097656 | A | 10/2014 | |
| CN | 107031680 | A | 8/2017 | |
| EP | 0578037 | A1 * | 1/1994 | B61G 3/20 |
| GB | 448876 | A * | 6/1936 | B61G 3/16 |
| KR | 20050065508 | A | 6/2005 | |
| KR | 20160020025 | A | 2/2016 | |

OTHER PUBLICATIONS

The International Search Report of corresponding International PCT application No. PCT/CN2018/073167, dated Apr. 20, 2018.

* cited by examiner (a)

(b)

(c)

COUPLER UNCOUPLING CONTROL MECHANISM

CROSS-REFERENCE TO RELATED APPLICATION

This application is a continuation of International Application No. PCT/CN2018/073167 filed on Jan. 18, 2018, which in turn claims the priority benefits of Chinese application No. 201710253112.1 filed on Apr. 18, 2018. The contents of these prior applications are hereby incorporated by reference in its entirety.

TECHNICAL FIELD

The present application belongs to the technical field of train couplers and particularly relates to a coupler uncoupling control mechanism.

BACKGROUND ART

Couplers are vehicle components used for coupling a locomotive with a carriage or a carriage with another carriage in order to transfer traction and impact force and keep a certain distance between carriages. FIG. 1 is a schematic diagram of an entire structure of a coupling system for train couplers; FIG. 2 is a schematic structure diagram of a mechanical coupler 6, where FIG. 2(*a*) is a schematic structure diagram of the mechanical coupler 6, FIG. 2(*b*) is a sectional view of the mechanical coupler 6 in a coupled state, and FIG. 2(*c*) is a sectional view of the mechanical coupler 6 in a to-be-coupled state after uncoupling; FIG. 3 is a state diagram of two mechanical couplers 6 when coupled; and, FIG. 4 is a schematic diagram of the airflow paths connection of a prior coupler uncoupling control mechanism. As shown in FIG. 1, a train coupler comprises a mechanical coupler 6 and two electrical couplers 5. The mechanical coupler 6 is connected to an uncoupling cylinder 4 used for uncoupling the mechanical coupler 6. Each of the electrical couplers 5 is connected to a propelling cylinder 3 capable of driving the electrical coupler 5 to do a reciprocating linear motion so as to realize coupling and uncoupling. Each of the electrical couplers 5 is slidingly connected to a guide rod 8 used for ensuring the linear motion of the electrical coupler 5. The guide rods 8 are mounted on guide mounting frames respectively on two sides of the mechanical coupler 6. Positioning pins 9 and positioning sleeves 10 are provided on the electrical couplers 5 to position the electrical couplers 5 during coupling.

As shown in FIG. 2, the mechanical coupler 6 mainly comprises a mechanical coupler body 61, a coupling rod 62 and a coupler knuckle 63. The coupling rod 62 is hinged to the coupler knuckle 63 and may be driven to do a reciprocating motion by the rotation of the coupler knuckle 63 in order to realize the coupling and uncoupling of two mechanical couplers 6. A spindle 64 is disposed in the center of the coupler knuckle 63 and the coupler knuckle 63 may drive the spindle 64 to synchronously rotate by a key 65. As shown in FIG. 2(*a*), the spindle 64 is fixedly connected to a cam 7, and the cam 7 is press-fitted with a first valve body 2 in a coupled state. In addition, as shown in FIG. 2(*b*), in the coupled state, the uncoupling cylinder 4 is disposed near the coupler knuckle 63; and, after stretched out, a cylinder rod of the uncoupling cylinder 4 may push the coupler knuckle 63 to rotate so as to realize the uncoupling of mechanical couplers 6.

As shown in FIG. 4, the airflow paths connection of a prior coupler uncoupling control mechanism is as follows: the uncoupling cylinder 4 is connected to an uncoupling pipe 12 (represented by an airflow path in this figure, where air enters from the end D) of the train by airflow path, each of the propelling cylinders 3 is connected to a main reservoir pipe 11 (represented by an airflow path in this figure, where main air is input to the main reservoir pipe 11 from the end C, and the main air is not only main air from an opposite coupled carriage but also main air supplied by this carriage) of the train by airflow path, and the first valve body 2 is connected between the propelling cylinder 3 and the main reservoir pipe 11.

As shown in FIG. 3, when two mechanical couplers 6 are to be coupled, the coupling rod 62 hooks the coupler knuckle 63 of the opposite mechanical coupler 6, realizing the coupling of two mechanical couplers 6. In this case, the state of each mechanical coupler 6 is shown in FIG. 2(*b*). When the two mechanical couplers 6 are to be uncoupled, the train issues a control signal for controlling the uncoupling pipe 12 to inflate air to the uncoupling cylinder 4 (that is, air enters from the end D), and the cylinder rod in the uncoupling cylinder 4 is stretched out and drives the coupler knuckle 63 to rotate clockwise. On one hand, as shown in FIG. 2(*c*), the clockwise rotation of the coupler knuckle 63 drives the coupling rod 62 to retract, so that the coupling rod 62 is uncoupled from the coupler knuckle 63 of the opposite mechanical coupler 6, realizing the uncoupling of the two mechanical couplers 6. On the other hand, the coupler knuckle 63 drives the spindle 64 to rotate by the key 65, so as to drive the cam 7 to rotate. When the cam 7 does not press the first valve body 2, the airflow path of the first valve body 2 is switched, and the flow direction of airflow in the propelling cylinder 3 is changed. As a result, the cylinder rod of the propelling cylinder 3 is changed from a stretched state to a retracted state, and the electrical couplers 5 are retracted along the guide rods 8, until the electrical couplers 5 of the train are uncoupled.

However, since the uncoupling process of the mechanical coupler 6 is prior to that of the electrical couplers 5 (the electrical couplers 5 begins to be uncoupled only when the airflow path in the first valve body 2 is switched), it is very likely that the uncoupling processes of the electrical couplers 5 have not completed when the uncoupling process of the mechanical coupler 6 is completed. In this case, the positioning pins 9 on two coupled electrical couplers 5 are not separated from the positioning sleeves 11 on the opposite electrical couplers 5. Since the mechanical coupler 6 has been uncoupled at this time, the couplers of two coupled carriages that are not completely uncoupled will form an angle under gravity due to the difference in height (the height of the couplers may be different due to an air spring or the like). As a result, the guide rods 8 mounted on the guide mounting frames on two sides of the mechanical coupler 6 will force the coupled electrical couplers 5 of two trains have a tendency to form a certain angle, thereby generating a large local contact force between the connected positioning pins 9 and positioning sleeves 10. This local contact force will affect the uncoupling operation of the electrical couplers 5 or even cannot complete the uncoupling of the electrical couplers 5 due to seizure.

SUMMARY OF THE PRESENT INVENTION

In view of the technical problem that the prior coupler uncoupling control mechanism affects the uncoupling process of electrical couplers or even cannot realize the uncoupling of electrical couplers due to seizure, the present application provides a new coupler uncoupling control mechanism.

For the abovementioned purpose, the present application employs the following technical solutions.

A coupler uncoupling control mechanism, comprising an uncoupling cylinder and a propelling cylinder connected to a main reservoir pipe of a train, wherein the uncoupling cylinder comprises an air inlet communicated with an uncoupling pipe of the train; a chamber is formed within the propelling cylinder, and the chamber of the propelling cylinder comprises an air inlet chamber and an air outlet chamber; the propelling cylinder is connected to a first valve body, and the first valve body comprises a first air inlet connected to the main reservoir pipe of the train, a first air outlet communicated with the first air inlet, a second air inlet and a second air outlet communicated with the second air inlet; the first air outlet is communicated with the air inlet chamber of the propelling cylinder, and the second air inlet is communicated with the air outlet chamber of the propelling cylinder, so that a cylinder rod of the propelling cylinder is allowed to do a retraction motion; the coupler uncoupling control mechanism further comprises a control assembly capable of suspending a motion of a cylinder rod of the uncoupling cylinder; the control assembly comprises a second valve body and the second valve body is a pneumatic control valve; the second valve body comprises a third air inlet communicated with the uncoupling pipe of the train, a third air outlet communicated with the third air inlet, and a first control port capable of controlling airflow communication between the third air inlet and the third air outlet after being triggered; and, the third air inlet is communicated with the air inlet of the uncoupling cylinder, and the first control port is connected to the first air outlet of the first valve body.

Compared with the prior art, the present application has the following advantages and positive effects.

(1) In the coupler uncoupling control mechanism of the present application, by providing the second valve body, when the cylinder rod of the propelling cylinder begins to retract, the uncoupling motion of the cylinder rod of the uncoupling cylinder is stopped due to the decreased amount of airflow input to the uncoupling cylinder from the uncoupling pipe. Accordingly, it is effectively avoided that the uncoupling operation of the electrical coupler is affected by the separation of coupled mechanical couplers of the train during the uncoupling process of the electrical coupler or even the electrical coupler cannot be uncoupled due to seizure, and the successful uncoupling of the electrical coupler can be effectively ensured.

(2) In the coupler uncoupling control mechanism of the present application, by providing the second valve body, the third valve body and the air reservoir, the time of suspending the uncoupling operation of the mechanical coupler can be prolonged, and the uncoupling process of the mechanical coupler is delayed. Meanwhile, it can be effectively ensured that the air in the uncoupling pipe of the train is completely blocked by the second valve body after the electrical coupler 3 leaves a position where it is prone to be stuck (that is, after the positioning pins and the positioning sleeves are separated from each other), and the uncoupling process of the mechanical coupler will not be affected any more.

Figure 1:
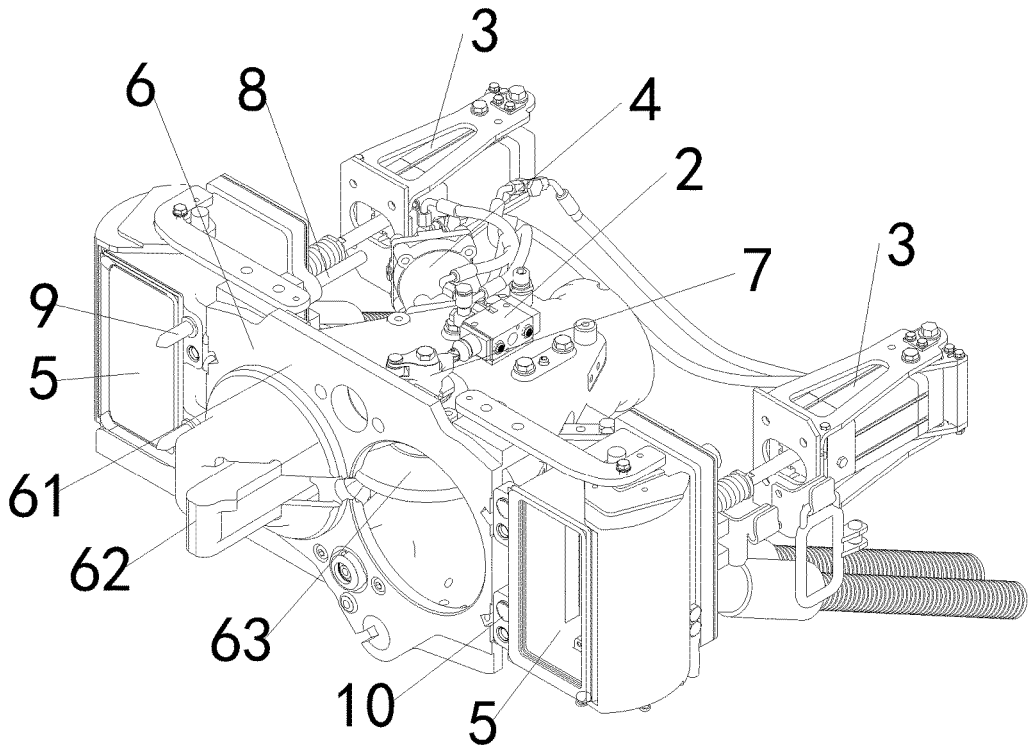
FIG. 1 is a schematic diagram of an entire structure of a train coupler.
Figure 2:
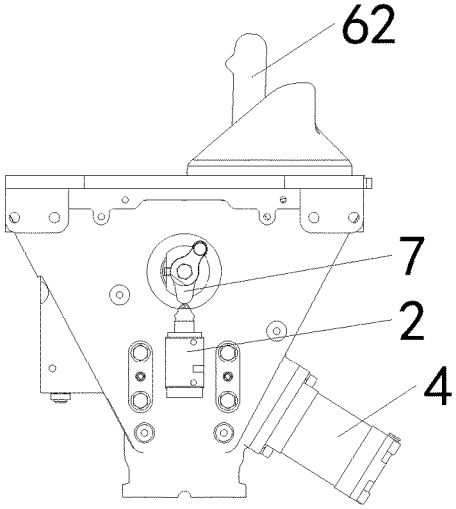
FIG. 2 is a schematic structure diagram of a mechanical coupler.
Figure 2:
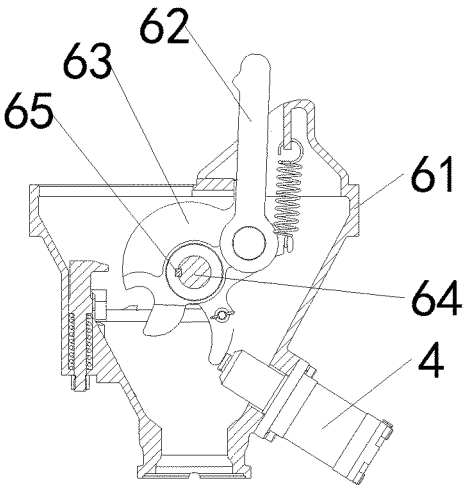
Figure 2:
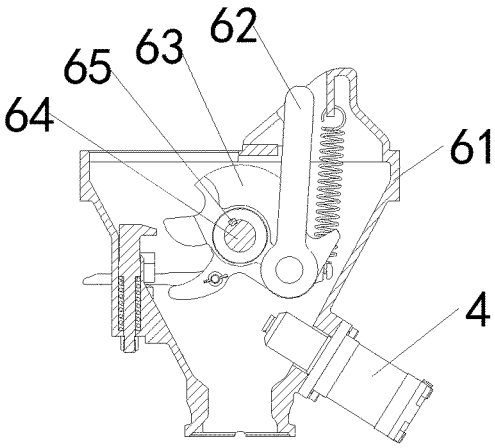

in which:

1: control assembly; 101: second valve body; 1011*a*: third air inlet; 1011*b*: third air outlet; 1012: first control port; 102: third valve body; 1021*a*: fourth air inlet; 1021*b*: fourth air outlet; 1022: second control port; 1023: second exhaust port; 103: time-delay unit; 1031: air reservoir; 1031*a*: fifth air inlet; 1031*b*: fifth air outlet; 1032: throttle valve; 1033: one-way valve; 2: first valve body; 201*a*: first air inlet; 201*b*: first air outlet; 202*a*: second air inlet; 202*b*: second air outlet; 203: first exhaust port; 3: propelling cylinder; 31: air inlet chamber; 32: air outlet chamber; 4: uncoupling cylinder; 401: air inlet of the uncoupling cylinder; 5: electrical coupler; 6: mechanical coupler; 61: mechanical coupler body; 62: coupling rod; 63: coupler knuckle; 64: spindle; 65: key; 7: cam; 8: guide rod; 9: positioning pin; 10: positioning sleeve; 11: main reservoir pipe; and, 12: uncoupling pipe.

DETAILED DESCRIPTION OF THE PRESENT INVENTION

The present application will be specifically described below by exemplary embodiments. However, it should be understood that elements, structures and features in one embodiment can be advantageously integrated into other embodiments without further recitation.

It should be noted that, in the description of the present application, the terms "first", "second", "third", "fourth" and "fifth" are merely used for descriptive purpose and cannot be interpreted as indicating or implying the relative importance. The terms "air inlet" and "air outlet" are definitions of air ports according to the flow direction of airflow in valve bodies in a certain state and cannot be interpreted as limitations to the flow direction of airflow in other states. Unless otherwise specially stated, the connection in the present application represents an airflow path connection. The airflow paths in the drawings are represented by straight lines.

Embodiment 1

Figure 5:
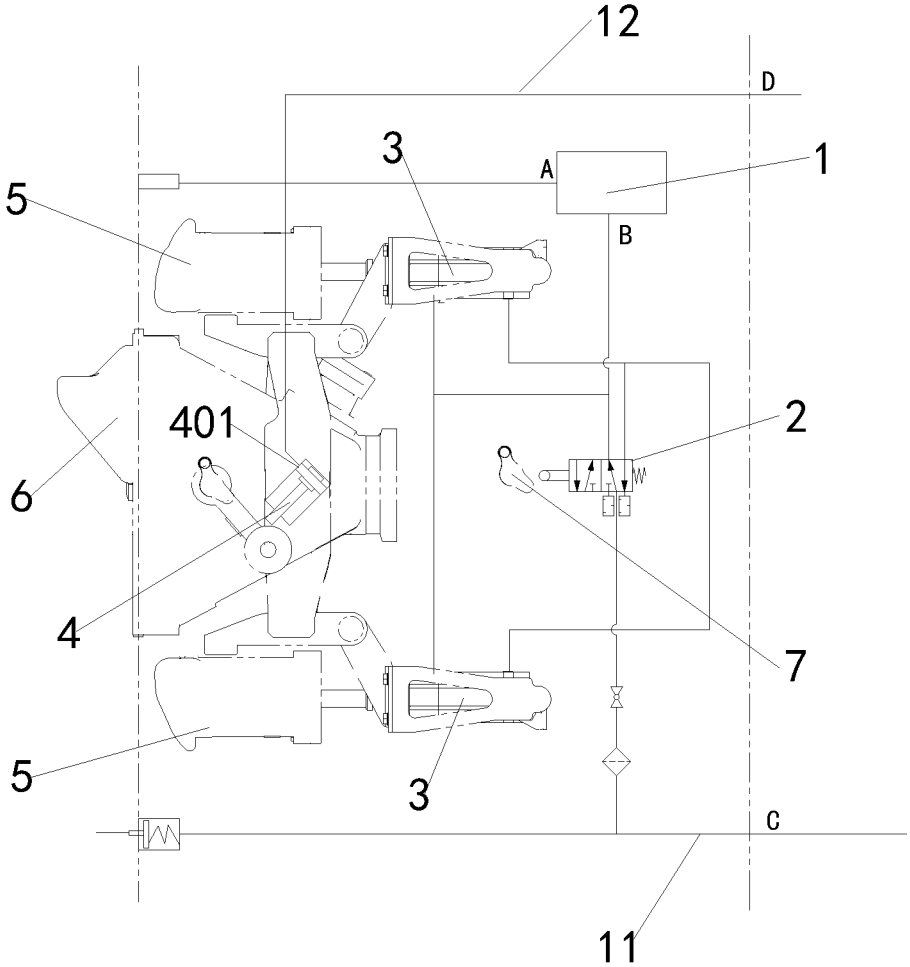
FIG. 5 is a schematic diagram of airflow paths connection of a coupler uncoupling control mechanism according to Embodiment 1 of the present application.
Figure 6:
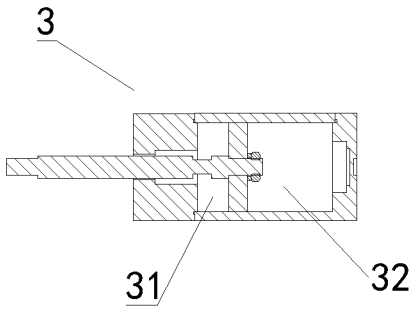
FIG. 6 is a sectional view of a chamber of a propelling cylinder according to Embodiment 1 of the present application.
Figure 7:
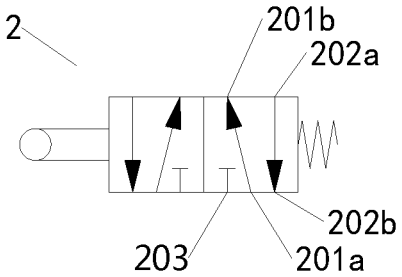
FIG. 7 is a schematic diagram of a first valve body according to Embodiment 1 of the present application.

As shown in FIG. 5, a coupler uncoupling control mechanism is provided, comprising an uncoupling cylinder 4. The uncoupling cylinder 4 comprises an air inlet 401 that communicated with an uncoupling pipe 12 of a train. The coupler uncoupling control mechanism further comprises propelling cylinders 3 connected to a main reservoir pipe 11 of the train. A chamber is formed within each of the propelling cylinders 3. The chamber comprises an air inlet chamber 31 and an air outlet chamber 32 (as shown in FIG. 6). The propelling cylinders 3 are connected to a first valve body 2. As shown in FIGS. 5 and 7, the first valve body 2 comprises a first air inlet 201*a* connected to the main reservoir pipe 11 of the train, a first air outlet 201*b* communicated with the first air inlet 201*a*, a second air inlet 202*a*, and a second air outlet 202*b* communicated with the second air inlet 202*a*. The first air outlet 201*b* is communicated with the air inlet chamber 31 of each of the propelling cylinders 3, and the second air inlet 202*a* is communicated with the air outlet chamber 32 of each of the propelling cylinders 3, so that a cylinder rod of each of the propelling cylinders 3 is allowed to do a retraction motion (i.e., driving electrical couplers 5 to do uncoupling motions).

The air inlet chamber 31 and the air outlet chamber 32 of the propelling cylinder 3 are defined depending upon the flow direction of airflow therein when the propelling cylinder 3 drives the electrical cylinder 5 to do an uncoupling motion; however, in a case where the propelling cylinder 3 drives the electrical coupler 5 to couple, the flow direction of airflow therein is opposite to the flow direction during uncoupling, that is, air enters from the air outlet chamber 32 and exits from the air inlet chamber 31.

Further, as shown in FIG. 5, the coupler uncoupling control mechanism further comprises a control assembly 1 capable of suspending the uncoupling motion of the cylinder rod of the uncoupling cylinder 4, so that the uncoupling operation of the mechanical coupler 6 can be suspended. One end (end A) of the control assembly 1 is connected to the uncoupling pipe 12, while the other end (end B) thereof is connected to the first valve body 2.

Figure 8:
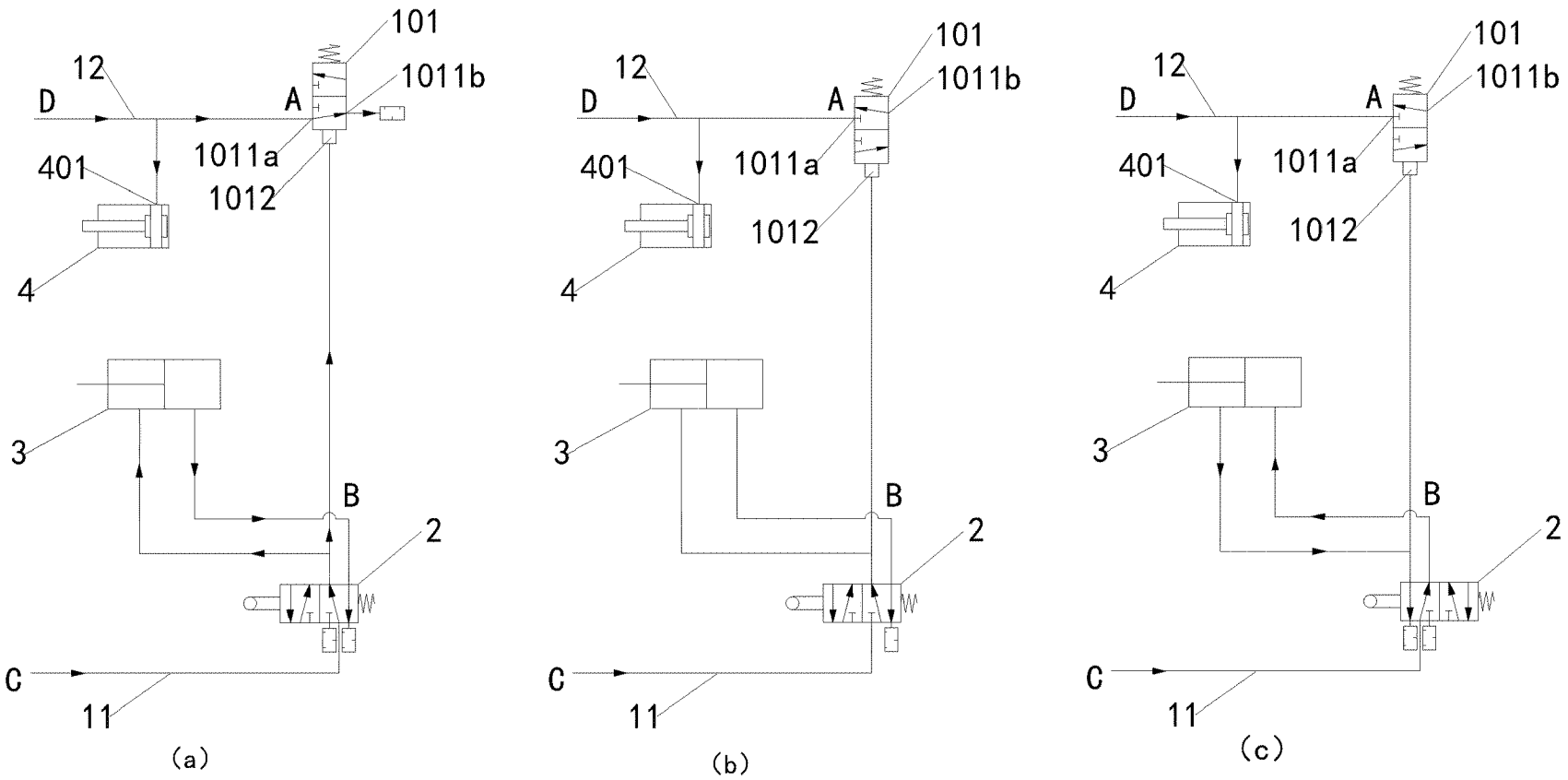
FIG. 8 is a schematic state diagram of airflow paths of the coupler uncoupling control mechanism according to Embodiment 1 of the present application.

As shown in FIG. 8, the control assembly 1 comprises a second valve body 101 which is a pneumatic control valve. The second valve 101 comprises a third air inlet 1011*a* communicated with the uncoupling pipe 12 (air enters from the end A), a third air outlet 1011*b* communicated with the third air inlet 1011*a* (air is discharged to atmosphere), and a first control port 1012 capable of controlling airflow communication between the third air inlet 1011*a* and the third air outlet 1011*b* after being triggered. The third air inlet 1011*a* is communicated with the air inlet 401 of the uncoupling cylinder 4, and the first control port 1012 is connected to the first air outlet 201*b* of the first valve body 2.

The pneumatic control valve is a valve body which controls the motion of an internal valve core by using airflow so as to place the valve core at different positions such that the switchover between internal airflow paths can be realized. The second valve body 101 shown in FIG. 8 is a two-position three-way valve having three air ports formed thereon. The switchover between different positions of the valve core is controlled by the first control port 1012, and there are two different conditions (upper and lower positions shown in FIG. 8) for the airflow paths in the second valve body 101 when the valve core is at different positions. Wherein, in the present application, the condition for triggering the first control port 1012 is that there is air flowing to the first control port 1012. In this case, the second valve 101 is at the lower position as shown in the figure, that is, air flows between the third air inlet 1011*a* and the third air outlet 1011*b*. It should be understood that the second valve body 101 may also be a two-position two-way valve or other types of pneumatic control valves as long as the airflow path within the second valve body 101 can be switched on or off.

The operation principle of the second valve body 101 will be described as below. As shown in FIG. 8(*a*), airflow in the main reservoir pipe 11 enters from the first air inlet 201*a* of the first valve body 2 and exits from the first air outlet 201*b* of the first valve body 2. Then, a part of the airflow flows to the first control port 1012 such that the first control port 1012 is triggered. After the first control port 1012 is triggered, the second valve body 101 is switched such that the third air inlet 1011*a* communicates with the third air outlet 1011*b* to form an airflow path, so that a part of airflow in the uncoupling pipe 12 is discharged to atmosphere through the second valve body 101, and airflow shunting in the uncoupling pipe 12 is such realized. As a result, the amount of airflow entering the uncoupling cylinder 4 is decreased, the air pressure cannot drive the cylinder rod to stretch out, and thus the uncoupling operation of the mechanical coupler 6 is suspended. At this time, the electrical couplers 5 are uncoupled first under the drive of the propelling cylinders 3. Subsequently, as shown in FIG. 8(*b*), the airflow path between the main reservoir pipe 11 and the first valve body 2 is cut off. At this time, no air flows to the first control port 1012, the trigger state of the first control port 1012 is closed, and the second valve body 101 is switched. Accordingly, the airflow path between the third air inlet 1011*a* and the third air outlet 1011*b* in the second valve body 101 is cut off, all the airflow in the uncoupling pipe 12 enters the uncoupling cylinder 4, and the mechanical coupler 6 will continuously perform and complete uncoupling process. In this figure, for simplicity, only one propelling cylinder 3 is shown, but the other one propelling cylinder 3 has the same airflow paths as this propelling cylinder 3.

Preferably, as shown in FIG. 7, the first valve body 2 is a two-position five-way mechanical control valve. That is, the first valve body 2 has five air ports, further comprising a first exhaust port 203 in addition to the first air inlet 201*a*, the first air outlet 201*b*, the second air inlet 202*a* and the second air outlet 202*b*. When a valve core in the first valve body is placed at different positions by mechanical control, the airflow paths between the five air ports are changed to form two different positions, i.e., left and right positions shown in FIG. 7. In accordance with the airflow paths connection shown in FIG. 5, when the first valve body 2 is at the right position, as shown in FIG. 8(*a*), airflow in the propelling cylinder 3 enters from the air inlet chamber 31 and exits from the air outlet chamber 32 (air enters the air inlet chamber 31 of the propelling cylinder 3, and the piston rod is pushed to move to compress and discharge air in the air outlet chamber 32), and the propelling cylinder 3 drives the electrical coupler 5 to do an uncoupling motion. When the first valve body 2 is switched by mechanical control, that is, as shown in FIG. 8(*c*), when the first valve body 2 is at the left position, the airflow path in the first valve body 2 is changed into flowing from the first air inlet 201*a* to the second air inlet 202*a*, air enters the air outlet chamber 32 of the propelling cylinder 3, and the piston rod is pushed to discharge air in the air inlet chamber 31 of the propelling cylinder 3. Subsequently, air is discharged to the atmosphere through the path between the first air outlet 201*b* and the first exhaust port 203. Accordingly, the coupling of each of the electrical couplers 5 is realized.

Embodiment 2

Figure 9:
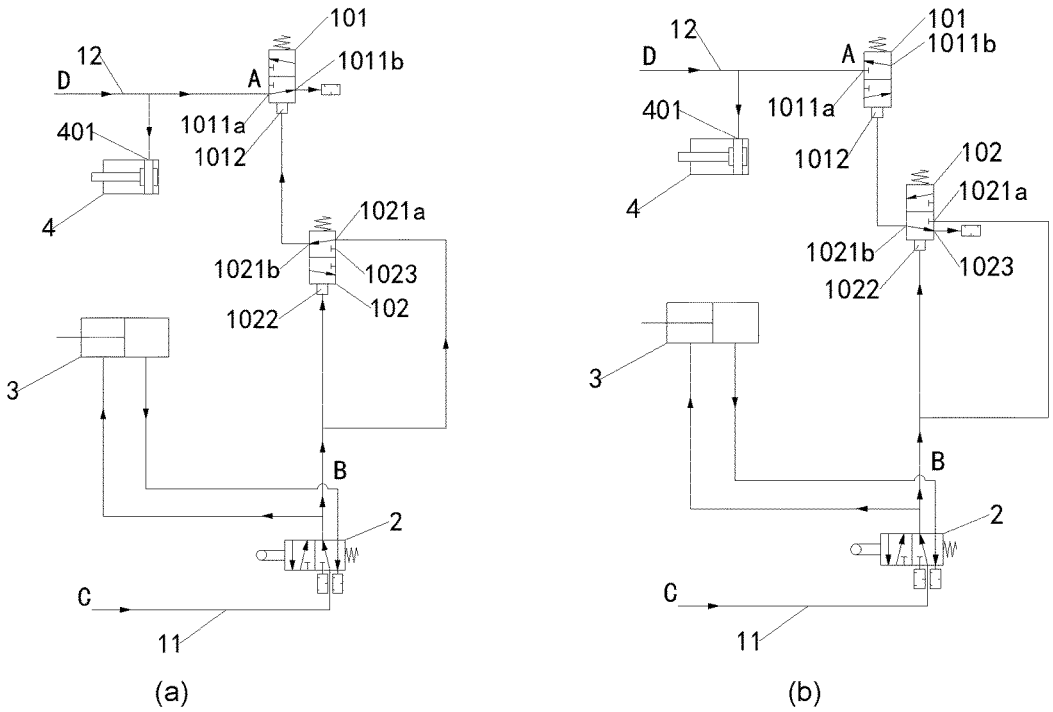
FIG. 9 is a schematic state diagram of airflow paths of a coupler uncoupling control mechanism according to Embodiment 2 of the present application.

Based on the Embodiment 1, in order to realize automatic control of coordination of the uncoupling motions of the electrical couplers 5 and the mechanical coupler 6, i.e., in order to realize the process that the uncoupling operation of the mechanical coupler 6 is suspended when the electrical couplers 5 begin to be uncoupled and the uncoupling operation of mechanical coupler 6 is restored to be normal after the electrical couplers 5 have been uncoupled completely or leaves a position where it is prone to be stuck, as shown in FIG. 9, the control assembly 1 further comprises a third valve body 102 connected between the second valve body 101 and the first valve body 2. The third valve body 102 is a pneumatic control valve, and comprises a fourth air inlet 1021*a*, a fourth air outlet 1021*b* communicated with the fourth air inlet 1021*a* and a second control port 1022 capable of cutting off the airflow communication between the fourth air inlet 1021*a* and the fourth air outlet 1021*b* after being triggered. The fourth air inlet 1021*a* is connected to the first air outlet 201*b* of the first valve body 2, the fourth air outlet 1021*b* is connected to the first control port 1012 of the second valve body 101, and the second control port 1022 is connected to the first air outlet 201*b* of the first valve body 2.

The condition for triggering the second control port 1022 is that the air pressure at the second control port 1022 reaches to a certain value. This air pressure value is defined as a trigger value of the second control port 1022. By connecting the third valve body 102, the airflow path in the second valve body 101 can be controlled. The specific process is described as below.

As shown in FIG. 9(*a*), airflow in the main reservoir pipe 11 enters from the first air inlet 201*a* of the first valve body 2 and exits from the first air outlet 201*b*. Then, a majority of the airflow enters the propelling cylinder 3 such that the propelling cylinder 3 drives the electrical coupler 5 to do an uncoupling motion. Apart of the airflow flows to the second control port 1022, and another part of the airflow flows to the first control port 1012 of the second valve body through the airflow path in the third valve body 102. Then, the first control port 1012 is triggered, and the second valve body 101 is switched, so that the third air inlet 1011*a* is communicated with the third air outlet 1011*b*. As a result, a part of airflow in the uncoupling pipe 12 is discharged to the atmosphere through the second valve body 101, and thus the airflow in the uncoupling pipe 12 is shunted. Consequently, the amount of airflow in the uncoupling cylinder 4 is decreased, and the uncoupling operation of the mechanical coupler 6 is suspended. At this time, the electrical coupler 5 is being uncoupled under the drive of the propelling cylinder 3. As shown in FIG. 9(*b*), when the airflow at the second control port 1022 is accumulated to a certain extent at which the air pressure reaches the trigger value (at this time, the electrical coupler 5 already leaves a position where it is prone to be stuck), the second control port 1022 is triggered, and the third valve body 102 is switched, so that the path between the fourth air inlet 1021*a* and the fourth air outlet 1021*b* is cut off. In this case, no air flows to the first control port 1012, the trigger state of the first control port 1012 is closed, and the second valve body 101 is switched. Accordingly, the airflow path between the third air inlet 1011*a* and the third air outlet 1011*b* in the second valve body 101 is cut off, all the airflow in the uncoupling pipe 12 enters the uncoupling cylinder 4, and the mechanical coupler 6 will be continuously uncoupled.

Preferably, the third valve 102 is a two-position three-way pneumatic control valve and further comprises a second exhaust port 1023. As shown in FIG. 9(*b*), when the path between the fourth air inlet 1021*a* and the fourth air outlet 1021*b* is cut off, that is, when the third valve body 102 is at the lower position in the figure, the fourth air outlet 1021*b* is communicated with the second exhaust port 1023, so that the airflow at the first control port 1012 can be discharged.

Embodiment 3

Figure 10:
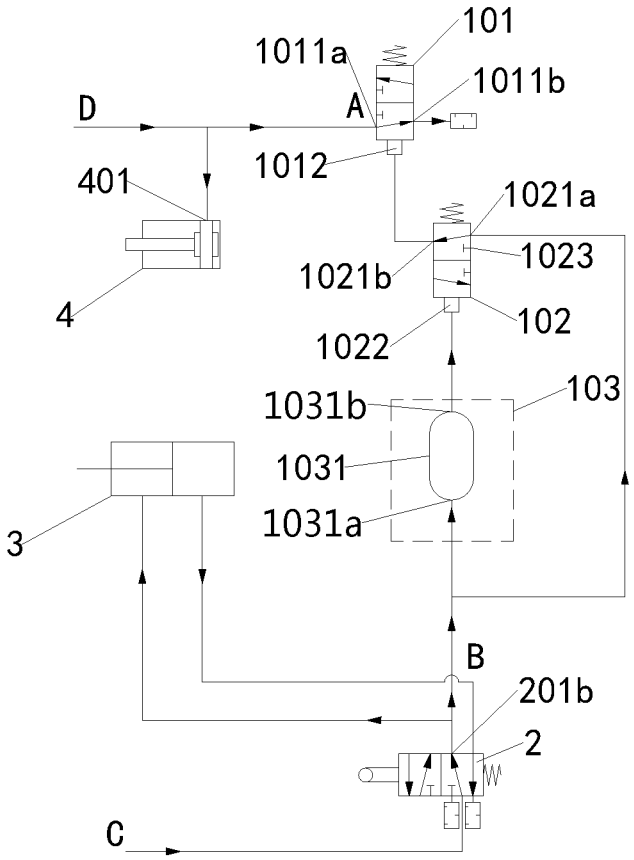
FIG. 10 is a first schematic diagram of airflow paths connection of a coupler uncoupling control mechanism according to Embodiment 3 of the present application.

Based on the Embodiment 2, in order to further delay the uncoupling process of the mechanical coupler 6 and ensure that the mechanical coupler 6 will be continuously uncoupled only after the electrical coupler 5 already leaves a position where it is prone to be stuck or has been uncoupled completely, as shown in FIG. 10, the control assembly 1 further comprises a time-delay unit 103 (shown by the dashed box in FIG. 10) capable of controlling the response time for cutting off the airflow communication in the third valve body 102. One end of the time-delay unit 103 is connected to the second control port 1022, while the other end thereof is connected to the first air outlet 201*b* of the first valve body 2. When no airflow signal is input to the time-delay unit 103, the time-delay unit 103 is turned off; and, when an airflow signal is input to the time-delay unit 103, the time-delay unit 103 delays the delivery of the airflow signal. In other words, when there is air flowing through the time-delay unit 103, the time-delay unit 103 may delay the accumulation of the air pressure at the second control port 1022.

As shown in FIG. 10, preferably, the time-delay unit 103 comprises an air reservoir 1031 with a chamber formed therein. The air reservoir 1031 comprises a fifth air inlet 1031*a* and a fifth air outlet 1031*b* both communicated with the chamber. The fifth air inlet 1031*a* is connected to the first air outlet 201*b* of the first valve body 2, and the fifth air outlet 1031*b* is connected to the second control port 1022 of the third valve body 102. The air reservoir 1031 can temporarily store airflow and can thus delay the time required by the air pressure at the second control port 1022 to reach the trigger value. Consequently, the uncoupling motion of the uncoupling cylinder 4 is delayed, and the uncoupling process of the mechanical coupler 6 is eventually delayed.

Figure 11:
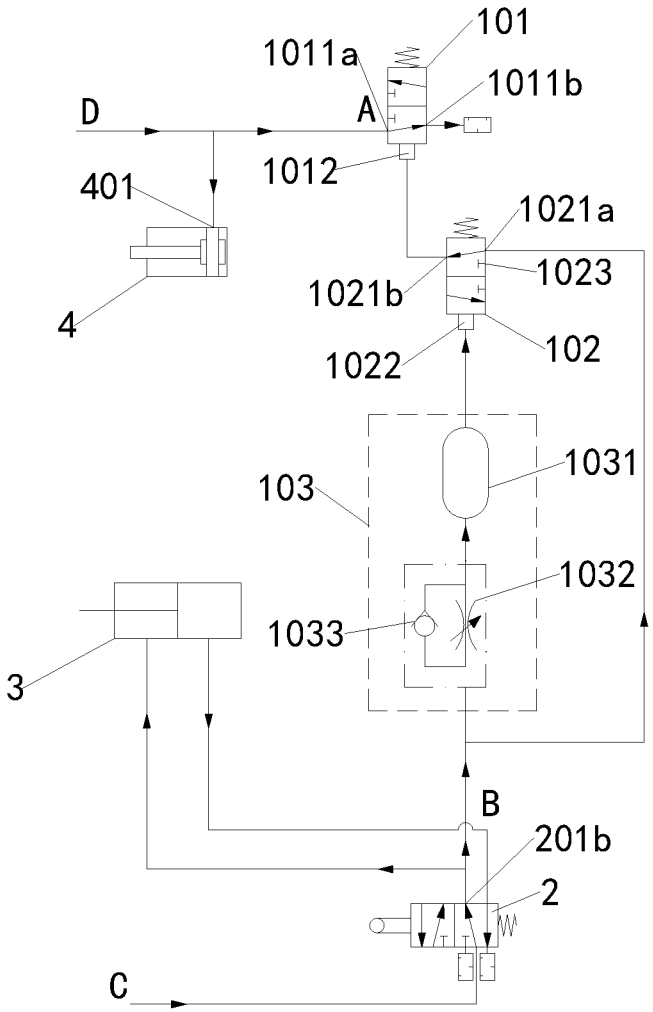
FIG. 11 is a second schematic diagram of the airflow paths connection of the coupler uncoupling control mechanism according to Embodiment 3 of the present application.
Figure 12:
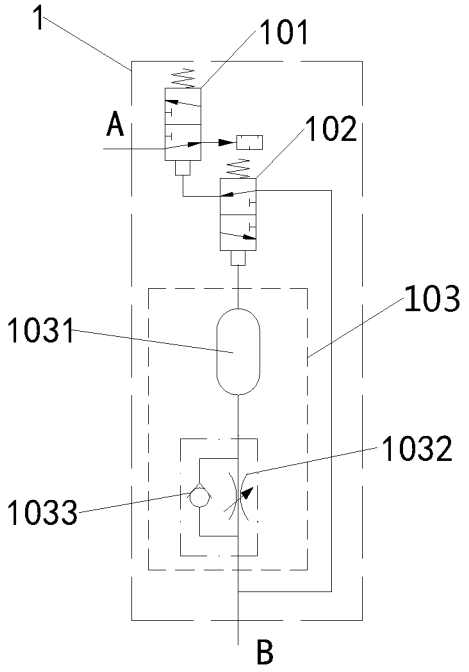
FIG. 12 is a schematic diagram of a control assembly 1 of the coupler uncoupling control mechanism according to Embodiment 3 of the present application.

Preferably, in order to further delay the time to trigger the second control pot 1022, as shown in FIGS. 11 and 12, the time-delay unit 103 further comprises a throttle valve 1032 connected between the air reservoir 1031 and the first valve body 2. An air inlet end and an air outlet end of the throttle valve 1032 are communicated with the first air outlet 201*b* of the first valve body 2 and the fifth air inlet 1031*a* of the air reservoir 1031, respectively. The throttle valve 1032 can reduce the flow rate of the airflow entering the air reservoir 1031 and can thus delay the accumulation speed of air in the air reservoir 1031. Accordingly, the time required by the air pressure at the second control port 1022 to reach the trigger value is further delayed, and the time to trigger the second control port 1022 is further delayed.

Preferably, the throttle valve 1032 is connected to a one-way valve 1033 in parallel, and the flow direction of air in the one-way valve 1033 is from the air outlet end of the throttle valve 1032 to the air inlet end of the throttle valve 1032, i.e., opposite to the flow direction of airflow in the throttle valve 1032. The one-way valve 1033 can quickly discharge air when there is no air pressure at the end B.

As shown FIG. 12, in this case, the control assembly 1 comprises the second valve body 101, the third valve body 102, the air reservoir 1031, the throttle valve 1032 and the one-way valve 1033.

To better understand the technical solutions of the present application, the working principle of the coupler uncoupling control mechanism of the present application will be described as below with reference to FIGS. 11-15.

Figure 13:
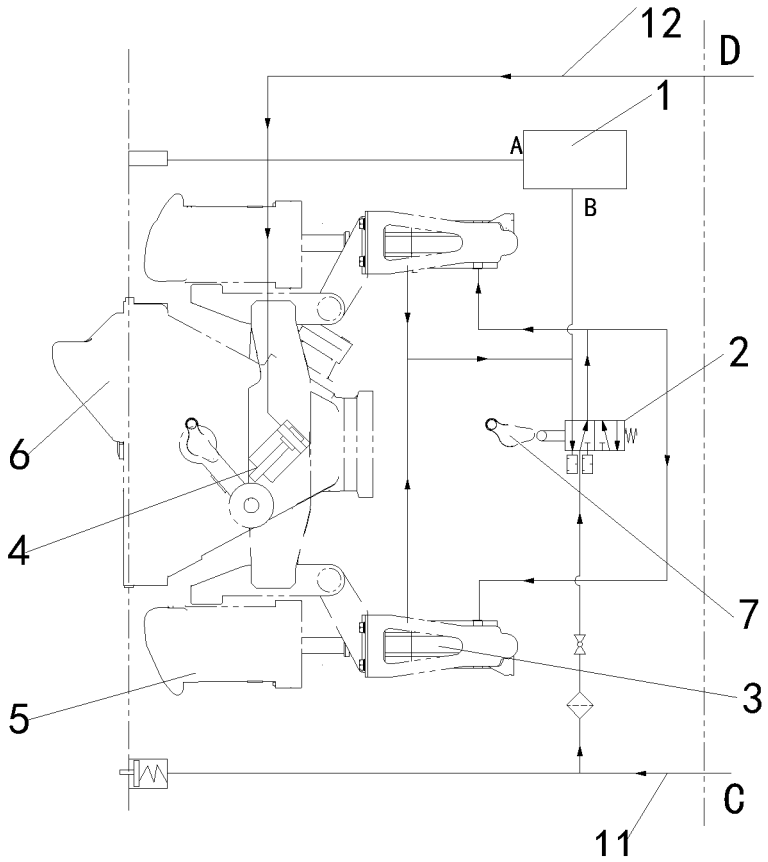
FIG. 13 is a schematic state diagram of airflow paths when the coupler uncoupling control mechanism begins to perform an uncoupling operation according to the Embodiments of the present application.

At the beginning of uncoupling, as shown in FIG. 13, the uncoupling pipe 12 receives an uncoupling signal and then inputs uncoupling airflow to the uncoupling cylinder 4 from the end D, so as to activate the uncoupling operation of the mechanical coupler 6. Meanwhile, main air in the main reservoir pipe 11 is input from the end C and then flows into the air outlet chamber 32 of each of the propelling cylinders 3 through the first valve body 2 (at the left position), so that the cylinder rod of each of the propelling cylinders 3 is kept in a stretched state, that is, each of the electrical couplers 5 is kept in a coupled state.

Figure 14:
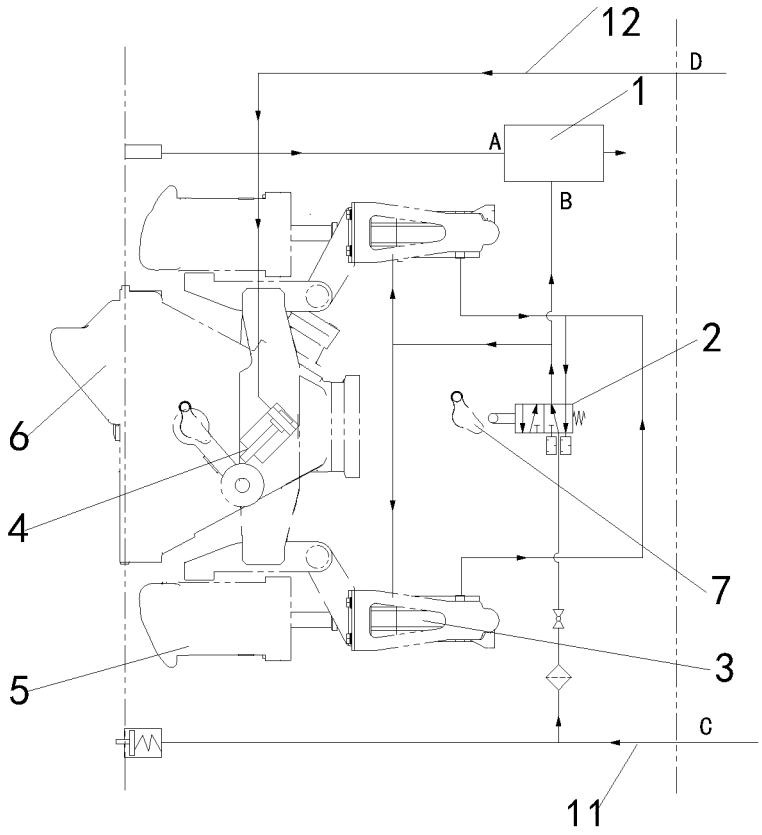
FIG. 14 is a schematic state diagram of the airflow paths when the control assembly of the coupler uncoupling control mechanism plays a shunting role according to the Embodiments of the present application.

Further, as shown in FIG. 14, since the rotation of a coupler knuckle 63 during the uncoupling process of the mechanical coupler 6 drives the cam 7 to rotate and separate from the first valve body 2, the airflow path in the first valve body 2 is switched (at the right position). At this time, main air in the main reservoir pipe 11 input from the end C successively flows through the first air inlet 201*a* and the first air outlet 201*b* of the first valve body 2. A part of the main air flows into the control assembly 1 through the end B and triggers the first control port 1012 of the second valve body 101, so that the third air inlet 1011*a* of the second valve body 101 is in airflow communication with the third air outlet 1011*b* of the second valve body 101 (referring to FIG. 11). At this time, a part of airflow in the uncoupling pipe 12 input from the end D is shunted to the second valve body 101 and then discharged to the atmosphere through the third air outlet 1011*b* of the second valve body 101. Another part of the airflow in the uncoupling pipe 12 flows into the uncoupling cylinder 4, and the uncoupling operation of the mechanical coupler 6 is suspended since air pressure of the airflow input to the uncoupling cylinder 4 cannot drive the cylinder rod of the uncoupling cylinder 4 to stretch out. In this case, since the coupling rod 62 of the mechanical coupler 6 has not been separated from a coupler knuckle 63 of a mechanical coupler 6 of the coupled train, the mechanical couplers 6 of the two coupled trains are kept consistent in height. In addition, another part of the main air flowing from the first air outlet 201*b* of the first valve body 2 flows into the air inlet chamber 31 of each of the propelling cylinders 3, and the cylinder rod of each of the propelling cylinders 3 is contracted, that is, the electrical coupler 5 is uncoupled.

Figure 15:
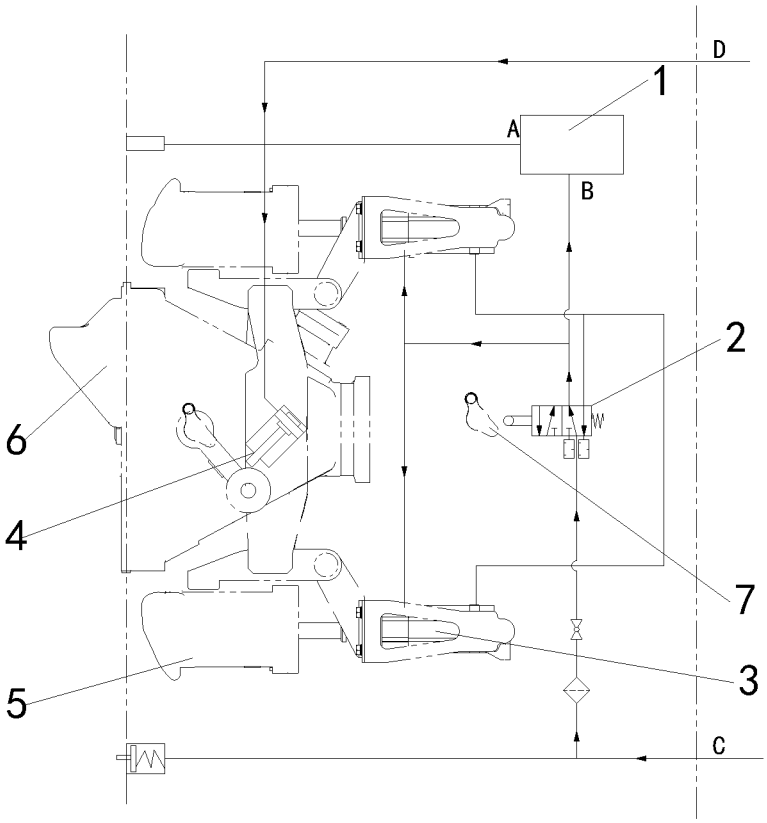
FIG. 15 is a schematic state diagram of the airflow paths after the control assembly of the coupler uncoupling control mechanism stops shunting according to the Embodiments of the present application.

During the above process, as shown in FIG. 11, a part of the main air flowing into the control assembly 1 through the end B successively flows through the fourth air inlet 1021*a* and the fourth air outlet 1021*b* of the third valve body 102 and then flows to the first control port 1012 of the second valve body 101, while another part of the main air is stored in the air reservoir 1031. As the volume of air in the chamber of the air reservoir increases, the air pressure in the chamber of the air reservoir increases. When the air pressure in the chamber of the air reservoir increases to an extent at which the second control port 1022 of the third valve body 102 can be triggered, the second control port 1022 of the third valve body 102 is triggered, and the airflow path of the third valve body 102 is then switched. The airflow path between the fourth air inlet 1021*a* and the fourth air outlet 1021*b* is cut off since the airflow path of the third valve body 102 is switched. At this time, each of the electrical couplers 5 already leaves a position where it is prone to be stuck (that is, the positioning pins 9 and the positioning sleeves 10 have been separated from each other). Further, as shown in FIG. 15, after the airflow path of the third valve body 102 is switched, the first control port 1012 of the second valve body 101 is in an untriggered state, the airflow path of the second valve body 101 is switched (referring to FIGS. 8(*b*) and 9(*b*)), and the airflow path between the third air inlet 1011*a* and the third air outlet 1011*b* of the second valve body 101 is cut off, so that no air flows out from the second valve body 101. At this time, all the airflow in the uncoupling pipe 12 flows into the uncoupling cylinder 4, and the uncoupling cylinder 4 continuously drives the cylinder rod of the uncoupling cylinder 4 to stretch out due to the rise in air pressure of the inflowing air, that is, the mechanical coupler 6 will be continuously uncoupled, until the mechanical coupler 6 is completely uncoupled.

As described above, in the coupler uncoupling control mechanism of the present application, by providing the second valve body 101, the airflow in the uncoupling pipe 12 is shunted, and the uncoupling motion of the cylinder rod of the uncoupling cylinder 4 is suspended due to the decreased amount of airflow input to the uncoupling cylinder 4, so that the uncoupling of the mechanical coupler 6 is suspended during the uncoupling of the electrical coupler 5. Accordingly, it is effectively avoided that the uncoupling operations of the electrical couplers 5 are affected by the first completion of uncoupling of the mechanical coupler 6 during the uncoupling processes of the electrical couplers 5 or even the electrical couplers 5 cannot be uncoupled due to seizure, and the successful uncoupling of the electrical couplers 5 can be effectively ensured.

In addition, in the coupler uncoupling control mechanism of the present application, by providing the third valve body 102, the shunting process of the airflow in the second valve body 101 is controlled, that is, the shunting effect of the second valve body 101 can be stopped after the electrical couplers 5 have left a position where it is prone to occur be stuck (that is, after the positioning pins 9 and the positioning sleeves 10 are separated from each other), so that all the airflow in the uncoupling pipe 12 flows into the uncoupling cylinder 4. Accordingly, the mechanical coupler 6 is restored to the normal uncoupling process, and the automatic coordination of the uncoupling process of the electrical couplers 5 and the mechanical coupler 6 is realized.

In the coupler uncoupling control mechanism of the present application, by providing the time-delay unit 103, the suspend time of the uncoupling operation of the mechanical coupler 6 is prolonged, and it can be effectively ensured that the mechanical coupler 6 is restored to the normal uncoupling operation only after the electrical couplers 3 have already left where it is prone to be stuck.

Embodiment 4

Based on Embodiment 1, preferably, the second valve body 101 further comprises a first closed port connected to the uncoupling pipe 12 of the train. Thus, the airflow path in the second valve body 101 can be cut off when the first control port of the second valve body 101 is untriggered. Accordingly, sufficient air flows into the uncoupling cylinder 4 from the uncoupling pipe, and there is a sufficient force to push the cylinder rod of the uncoupling cylinder to continuously do an uncoupling motion.

The first closed port is a port on the second valve body 101 connected to the uncoupling pipe 12 when the path for allowing the airflow in the uncoupling pipe 12 to pass through the second valve body 101 is cut off. At this time, the valve core in the second valve body 101 is switched such that the third air inlet 1011*a* is blocked. Therefore, the third air inlet 1011*a* is equivalent to the first closed port in this embodiment (referring to the second valve body 101 shown in FIG. 9(*b*)).

Further, in order to delay the uncoupling motion of the cylinder rod of the uncoupling cylinder 4, i.e., delay the uncoupling process of the mechanical coupler 6, as shown in FIGS. 11 and 12, the control assembly 1 further comprises a third valve body 102 connected between the second valve body 101 and the first valve body 2 and a time-delay unit 103 (shown by the dashed box in FIG. 11) capable of controlling the response time for cutting off the airflow communication in the third valve body 102. The third valve body 102 is a pneumatic control valve, and comprises a fourth air inlet 1021*a*, a fourth air outlet 1021*b* communicated with the fourth air inlet 1021*a*, a second control port 1022 capable of cutting off the airflow communication between the fourth air inlet 1021*a* and the fourth air outlet 1021*b* after being triggered and a second closed port capable of cutting off the airflow path in the third valve body 102. The fourth air inlet 1021*a* is connected to the first air outlet 201*b* of the first valve body 2, the fourth air outlet 1021*b* is connected to the first control port 1012 of the second valve body 102, and the second control port 1022 is connected to a time-delay unit 103 capable of triggering the second control port 1022. When no airflow signal is input to the time-delay unit 103, the time-delay unit 103 is turned off; and, when an airflow signal is input to the time-delay unit 103, the time-delay unit 103 delays the delivery of the airflow signal.

The second closed port is a port on the third valve body 102 connected to the end B when the path for allowing the airflow flowing from the end B to the third valve body 102 to pass through the third valve body 102 is cut off. At this time, the valve core in the third valve body 102 is switched such that the fourth air inlet 1021*a* is blocked. Therefore, the fourth air inlet 1021*a* is equivalent to the second closed port in this embodiment (referring to the third valve body 102 shown in FIG. 9(*b*)).

In this embodiment, by providing the second valve body 101, the third valve body 102 and the time-delay unit 103, the uncoupling process of the mechanical coupler 6 can be delayed, and it can be effectively ensured that the coupling process of the mechanical coupler 6 will not be affected and will be performed normally after the electrical couplers 5 have already left a position where it is prone to be stuck (that is, after the positioning pins 9 and the positioning sleeves 10 have been separated from each other).

Specifically, as shown in FIGS. 11 and 12, the time-delay unit 103 comprises an air reservoir 1031 with a chamber formed therein. The air reservoir 1031 comprises a fifth air inlet 1031*a* and a fifth air outlet 1031*b* both communicated with the chamber of the air reservoir. The fifth air inlet 1031*a* is connected to the first air outlet 201*b* of the first valve body 2, and the fifth air outlet 1031*b* is connected to the second control port 1022 of the third valve body 102. The air reservoir 1031 can temporarily store air output from the first valve body 2. After a certain period of time, the second control port 1022 of the third valve body 102 is triggered when the air pressure in the chamber of the air reservoir 1031 reaches a trigger value. By temporarily storing air by the air reservoir 1031, the trigger of the second control port 1022 is delayed, and the uncoupling process of the mechanical coupler 6 can thus be delayed.

Meanwhile, as shown in FIGS. 11 and 12, in order to prolong the time required by the air pressure in the air reservoir 1031 to reach the desired air pressure for triggering the second control port 1022 of the third valve body 102, a throttle valve 1032 is connected between the air reservoir 1031 and the first valve body 2, and an air inlet end and an air outlet end of the throttle vale 1032 are communicated with the first air outlet 201*b* of the first valve body 2 and the fifth air inlet 1031*a* of the air reservoir 1031, respectively. The throttle valve 1032 can reduce the flow rate of the airflow flowing in the air reservoir 1031 and thus can prolong the time required by the air pressure in the air reservoir 1031 to reach the desired air pressure for triggering the second control port 1022 of the third valve body 102, so that it is advantageous to effectively control the time to trigger the second control port 1022 of the third valve body 102.

Preferably, as shown in FIGS. 11 and 12, the third valve body 102 may be a two-position three-way pneumatic control valve.

In addition, as shown in FIGS. 11 and 12, the throttle valve 1032 is connected to a one-way valve 1033 in parallel. The flow direction of air in the one-way valve 1033 is from an air outlet end of the throttle valve 1032 to an air inlet end of the throttle valve 1032. The one-way valve 1033 can quickly discharge air when there is no air pressure at the end B.

Figure 3:
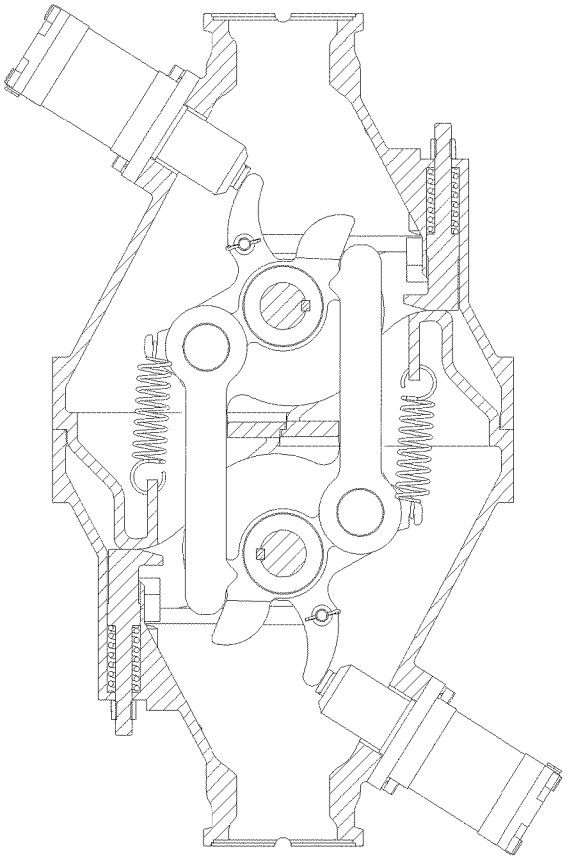
FIG. 3 is a sectional view of two mechanical couplers in a coupled state.
Figure 4:
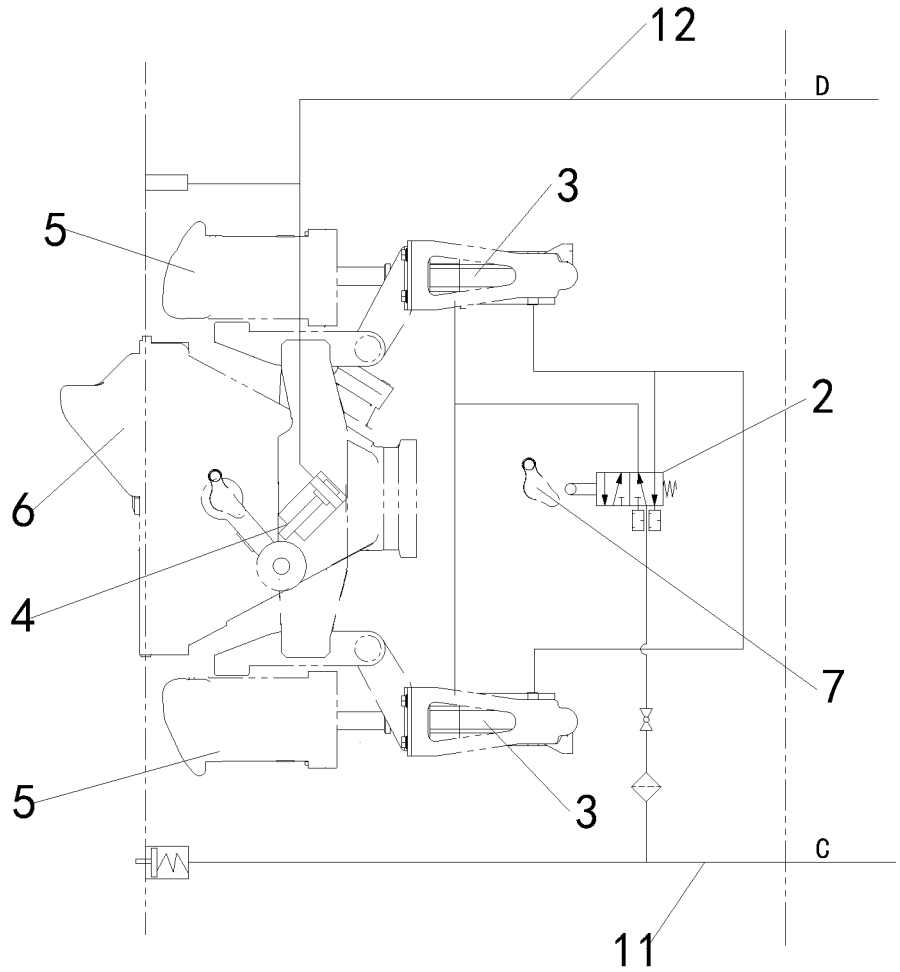
FIG. 4 is a schematic diagram of airflow paths connection of a prior coupler uncoupling control mechanism.

For the structure of the first valve body 2, as shown in FIGS. 3-5, the first valve body 2 may be a two-position five-way mechanical control valve.

What is claimed is:

1. A coupler uncoupling control mechanism, comprising an uncoupling cylinder (4) and a propelling cylinder (3) connected to a main reservoir pipe (11) of a train, wherein the uncoupling cylinder (4) comprises an air inlet (401) communicated with an uncoupling pipe (12) of the train; a chamber is formed within the propelling cylinder (3), and the chamber of the propelling cylinder comprises an air inlet chamber (31) and an air outlet chamber (32); the propelling cylinder (3) is connected to a first valve body (2), and the first valve body (2) comprises a first air inlet (201*a*) connected to the main reservoir pipe (11) of the train, a first air outlet (201*b*) communicated with the first air inlet (201*a*), a second air inlet (202*a*) and a second air outlet (202*b*) communicated with the second air inlet (202*a*); the first air outlet (201*b*) is communicated with the air inlet chamber (31) of the propelling cylinder, and the second air inlet (202*a*) is communicated with the air outlet chamber (32) of the propelling cylinder, so that a cylinder rod of the propelling cylinder (3) is allowed to do a retraction motion;

the coupler uncoupling control mechanism further comprises a control assembly (1) capable of suspending a motion of a cylinder rod of the uncoupling cylinder (4); the control assembly (1) comprises a second valve body (101) and the second valve body (101) is a pneumatic control valve; the second valve body (101) comprises a third air inlet (1011*a*) communicated with the uncoupling pipe (12) of the train, a third air outlet (1011*b*) communicated with the third air inlet (1011*a*), and a first control port (1012) capable of controlling airflow communication between the third air inlet (1011*a*) and the third air outlet (1011*b*) after being triggered; and, the third air inlet (1011*a*) is communicated with the air inlet (401) of the uncoupling cylinder (4), and the first control port (1012) is connected to the first air outlet (201*b*) of the first valve body (2).

2. The coupler uncoupling control mechanism according to claim 1, wherein, the control assembly (1) further comprises a third valve body (102) connected between the second valve body (101) and the first valve body (2); the third valve body (102) is a pneumatic control valve, and the third valve body (102) comprises a fourth air inlet (1021*a*), a fourth air outlet (1021*b*) communicated with the fourth air inlet (1021*a*) and a second control port (1022) capable of cutting off an airflow communication between the fourth air inlet (1021*a*) and the fourth air outlet (1021*b*) after being triggered; the fourth air inlet (1021*a*) is connected to the first air outlet (201*b*) of the first valve body (2), the fourth air outlet (1021*b*) is connected to the first control port (1012) of the second valve body (101), and the second control port (1022) is connected to the first air outlet (201*b*) of the first valve body (2).

3. The coupler uncoupling control mechanism according to claim 2, wherein, a condition for triggering the second control port (1022) is that an air pressure at the second control port (1022) reaches to a trigger value, and the trigger value is a pressure value of air accumulated at the second control port (1022) when a electrical coupler 5 already leaves a position where it is prone to be stuck.

4. The coupler uncoupling control mechanism according to claim 2, wherein, the third valve (102) is a two-position three-way pneumatic control valve and further comprises a second exhaust port (1023).

5. The coupler uncoupling control mechanism according to claim 2, wherein, the control assembly (1) further comprises a time-delay unit (103) capable of controlling a response time for cutting off the airflow communication in the third valve body (102); one end of the time-delay unit (103) is connected to the second control port (1022), while the other end of the time-delay unit (103) is connected to the first air outlet (201*b*) of the first valve body (2); when no airflow signal is input to the time-delay unit (103), the time-delay unit (103) is turned off, and when an airflow signal is input to the time-delay unit (103), the time-delay unit (103) delays the delivery of the airflow signal.

6. The coupler uncoupling control mechanism according to claim 5, wherein, the time-delay unit (103) comprises an air reservoir (1031) with a chamber formed therein; the air reservoir (1031) comprises a fifth air inlet (1031*a*) and a fifth air outlet (1031*b*) both communicated with the chamber of the air reservoir (1031), and the fifth air inlet (1031*a*) is connected to the first air outlet (201*b*) of the first valve body (2), and the fifth air outlet (1031*b*) is connected to the second control port (1022) of the third valve body (102).

7. The coupler uncoupling control mechanism according to claim 6, wherein, a throttle valve (1032) is connected between the air reservoir (1031) and the first valve body (2), and an air inlet end and an air outlet end of the throttle valve (1032) are communicated with the first air outlet (201*b*) of the first valve body (2) and the fifth air inlet (1031*a*) of the air reservoir (1031), respectively.

8. The coupler uncoupling control mechanism according to claim 7, wherein, the throttle valve (1032) is connected to a one-way valve (1033) in parallel, and a flow direction of air in the one-way valve (1033) is from the air outlet end of the throttle valve to the air inlet end of the throttle valve.

9. The coupler uncoupling control mechanism according to claim 1, wherein, the second valve body (101) further comprises a first closed port connected to the uncoupling pipe of the train, so that an airflow path in the second valve body (101) is cut off when the first control port of the second valve body (101) is untriggered.

10. The coupler uncoupling control mechanism according to claim 6, wherein, the control assembly (1) further comprises a third valve body (102) connected between the second valve body (101) and the first valve body (2) and a time-delay unit capable of controlling a response time for cutting off an airflow communication in the third valve body (102); the third valve body (102) is a pneumatic control valve and comprises a fourth air inlet (1021*a*), a fourth air outlet (1021*b*) communicated with the fourth air inlet (1021*a*), a second control port (1022) capable of cutting off the airflow communication between the fourth air inlet (1021*a*) and the fourth air outlet (1021*b*) after being triggered and a second closed port capable of cutting off the airflow path in the third valve body (102); the fourth air inlet (1021*a*) is connected to the first air outlet (201*b*) of the first valve body (2), the fourth air outlet (1021*b*) is connected to the first control port (1012) of the second valve body (101), and the second control port (1022) is connected to the time-delay unit (103) capable of triggering the second control port (1022); when no airflow signal is input to the time-delay unit (103), the time-delay unit (103) is turned off; and, when an airflow signal is input to the time-delay unit (103), the time-delay unit (103) delays delivery of the airflow signal.

11. The coupler uncoupling control mechanism according to claim 10, wherein, the time-delay unit (103) comprises an air reservoir (1031) with a chamber formed therein; the air reservoir (1031) comprises a fifth air inlet (1031*a*) and a fifth air outlet (1031*b*) both communicated with the chamber of the air reservoir (1031), and the fifth air inlet (1031*a*) is connected to the first air outlet (201*b*) of the first valve body (2), and the fifth air outlet (1031*b*) is connected to the second control port (1022) of the third valve body (102).

12. The coupler uncoupling control mechanism according to claim 11, wherein, a throttle valve (1032) is connected between the air reservoir (1031) and the first valve body (2), and an air inlet end and an air outlet end of the throttle valve (1032) are communicated with the first air outlet (201*b*) of the first valve body (2) and the fifth air inlet (1031*a*) of the air reservoir (1031), respectively.

13. The coupler uncoupling control mechanism according to claim 12, wherein, the throttle valve (1032) is connected to a one-way valve (1033) in parallel, and a flow direction of air in the one-way valve (1033) is from the air outlet end of the throttle valve to the air inlet end of the throttle valve.

14. The coupler uncoupling control mechanism according to claim 1, wherein, the second valve body (101) is a two-position three-way valve or a two-position two-way valve.

15. The coupler uncoupling control mechanism according to claim 1, wherein, the first valve body (2) is a two-position five-way mechanical control valve.

* * * * *